US007553339B2

(12) United States Patent
Schmiedl et al.

(10) Patent No.: US 7,553,339 B2
(45) Date of Patent: Jun. 30, 2009

(54) METHOD OF DYEING OR PRINTING TEXTILE FIBRE MATERIALS USING REACTIVE DYES

(75) Inventors: Jürgen Schmiedl, Steinen (DE); Wolfgang Mundle, Weil am Rhein (DE)

(73) Assignee: Huntsman International LLC, The Woodlands, TX (US)

( * ) Notice: Subject to any disclaimer, the term of this patent is extended or adjusted under 35 U.S.C. 154(b) by 227 days.

(21) Appl. No.: 10/578,214

(22) PCT Filed: Nov. 1, 2004

(86) PCT No.: PCT/EP2004/052742

§ 371 (c)(1), (2), (4) Date: May 4, 2006

(87) PCT Pub. No.: WO2005/045125

PCT Pub. Date: May 19, 2005

(65) Prior Publication Data

US 2007/0130703 A1 Jun. 14, 2007

(30) Foreign Application Priority Data

Nov. 11, 2003 (EP) ..... 03104150

(51) Int. Cl.
*C09B 62/00* (2006.01)

(52) U.S. Cl. ..... 8/543; 8/546; 8/549; 8/602; 8/618; 8/624; 8/625; 8/626; 8/629; 8/921; 8/924

(58) Field of Classification Search ..... 8/543–549, 8/602, 618, 624, 625, 626, 629, 921, 924
See application file for complete search history.

(56) References Cited

U.S. PATENT DOCUMENTS

| | | | | |
|---|---|---|---|---|
| 3,535,072 | A | 10/1970 | Cordillot | 8/54 |
| 3,933,421 | A * | 1/1976 | Lewis | 8/428 |
| 4,231,749 | A * | 11/1980 | Balland | 8/584 |
| 4,705,526 | A * | 11/1987 | Abel et al. | 8/555 |
| 4,826,503 | A | 5/1989 | Lande | 8/543 |
| 5,403,360 | A * | 4/1995 | Sutterlin et al. | 8/549 |
| 5,952,476 | A * | 9/1999 | Phillips et al. | 534/637 |
| 5,976,197 | A * | 11/1999 | Hutchings et al. | 8/543 |
| 6,394,597 | B1 | 5/2002 | Koike et al. | 347/106 |
| 2002/0138922 | A1 * | 10/2002 | Schmiedl et al. | 8/543 |

FOREIGN PATENT DOCUMENTS

| | | |
|---|---|---|
| CH | 425 713 | 6/1967 |
| DE | 31 13921 | 10/1982 |
| EP | 0 222 696 | 5/1987 |
| EP | 0 610 156 | 8/1994 |
| EP | 0 666 362 | 8/1995 |

OTHER PUBLICATIONS

English language Derwent Abstract 92860 E/44 for DE 31 13921 (Oct. 1982).

* cited by examiner

*Primary Examiner*—Lorna M Douyon
*Assistant Examiner*—Tri V Nguyen

(57) ABSTRACT

A method of dyeing or printing textile fiber materials, which comprises bringing the fiber material into contact with (a) at least one reactive dye containing at least one anionic group, (b) at least one compound which reduces the ionic character of the anionic group, and (c) at least one nucleophilic compound, yields dyeings or prints having deep hues and very good fastness properties.

7 Claims, No Drawings

METHOD OF DYEING OR PRINTING TEXTILE FIBRE MATERIALS USING REACTIVE DYES

The present invention relates to a method of dyeing or printing textile fibre materials using reactive dyes.

The problem underlying the present invention was to make available an easy to perform method of dyeing or printing textile fibre materials which results in dyeings or prints having a high depth of shade and very good fastness properties.

It has been found, surprisingly, that when, for example, synthetic polyamide fibre materials are dyed high depths of shade are obtained in conjunction with very good wet fastness and contact fastness properties when the fibre material is dyed using reactive dyes in the presence of suitable salts which improve the uptake behaviour and the fibre material is treated with suitable nucleophiles in accordance with the present invention.

The dyeings obtained solve the posed problem especially well. In particular, the dyeings obtained are distinguished by very good fastness properties, especially wet fastness properties, and by deep hues.

The problem posed is solved in accordance with the invention by the method described hereinbelow.

The present invention accordingly relates to a method of dyeing or printing textile fibre materials, which comprises bringing the fibre material into contact with (a) at least one reactive dye containing at least one anionic group, (b) at least one compound which reduces the ionic character of the anionic group, and (c) at least one nucleophilic compound.

Reactive dyes contain at least one fibre-reactive radical. Fibre-reactive radicals are to be understood in general as being those which are capable of reacting with the hydroxy groups of cellulose, with the amino, carboxy, hydroxy and thiol groups in wool and silk, or with the amino and possibly carboxy groups of synthetic polyamides to form covalent chemical bonds. The fibre-reactive radicals are generally bonded to the dye radical directly or via a bridging member. Suitable fibre-reactive radicals are, for example, those containing at least one removable substituent at an aliphatic, aromatic or heterocyclic radical or those wherein the mentioned radicals contain a radical suitable for reaction with the fibre material, for example a vinyl radical.

Reactive dyes are known and are described in large numbers, for example in Venkataraman "The Chemistry of Synthetic Dyes" Volume 6, Academic Press, New York, London 1972.

For the method according to the invention there is used, for example, at least one reactive dye of formula $$A\text{-}(Z)_k \qquad (1)$$

wherein

A is the radical of a monoazo, disazo, polyazo, metal complex azo, anthraquinone, phthalocyanine, formazan or dioxazine dye, Z independently denotes k fibre-reactive substituents, which may be identical or different from one another, selected from the group of the vinylsulfonyl, acryloyl and heterocyclic series, and k is a number 1,2 or 3.

Fibre-reactive radicals Z from the group of the vinylsulfonyl series are, for example, alkyl-sulfonyl radicals substituted by a removable atom or by a removable group or alkenylsulfonyl radicals which are unsubstituted or substituted by a removable atom or by a removable group. The mentioned alkylsulfonyl and alkenylsulfonyl radicals contain generally from 2 to 8, preferably from 2 to 4, and especially 2, carbon atoms.

Fibre-reactive radicals Z from the group of the acryloyl series are, for example, alkanoyl radicals substituted by a removable atom or by a removable group or alkenoyl radicals which are unsubstituted or substituted by a removable atom or by a removable group. The mentioned alkanoyl and alkenoyl radicals contain generally from 2 to 8, preferably 3 or 4, and especially 3, carbon atoms.

Examples of fibre-reactive radicals Z from the group of the heterocyclic series include heterocyclic radicals that contain 4-, 5- or 6-membered rings and that are substituted by a removable atom or by a removable group. Suitable heterocyclic radicals are, for example, those that contain at least one removable substituent bonded to a heterocyclic radical, inter alia those that contain at least one reactive substituent bonded to a 5- or 6-membered heterocyclic ring, for example to a monoazine, diazine, pyridine, pyrimidine, pyridazine, pyrazine, thiazine, oxazine or asymmetrical or symmetrical triazine ring, or to such a ring system that has one or more fused-on aromatic rings, for example a quinoline, phthalazine, quinazoline, quinoxaline, acridine, phenazine or phenanthridine ring system.

Removable atoms and removable groups or leaving groups are, for example, halogen, e.g. fluorine, chlorine or bromine, ammonium, including hydrazinium, sulfato, thiosulfato, phosphato, acetoxy, propionyloxy, azido, carboxypyridinium and rhodanido.

As a radical from the group of the vinylsulfonyl series, Z is preferably a radical of formula $—SO_2—CH{=}CH_2$ or $SO_2—CH_2—CH_2—U$ wherein U is a leaving group.

As a radical from the group of the acryloyl series, Z is preferably a radical of formula $—CO—CH(Hal)\text{-}CH_2(Hal)$ or $—CO—C(Hal){=}CH_2$ wherein Hal is chlorine or bromine.

As a radical from the group of the heterocyclic series, Z is preferably a halotriazine or halopyrimidine radical, especially a halotriazine radical, wherein the halogen is fluorine or chlorine.

Z is preferably $—SO_2—CH{=}CH_2$ or $—SO_2—CH_2—CH_2—U$, wherein U is a leaving group, $—CO—CH(Hal)\text{-}CH_2(Hal)$ or $—CO—C(Hal){=}CH_2$, wherein Hal is chlorine or bromine, or a halotriazine radical, wherein the halogen is fluorine or chlorine.

The fibre-reactive radicals Z and the dye radical A may be connected to one another by way of a bridging member. Suitable bridging members include, besides a direct bond or, for example, an amino group, a very wide variety of radicals. For example, the bridging member is an aliphatic, aromatic or heterocyclic radical; the bridging member may also be composed of various such radicals. The bridging member generally contains at least one functional group, for example the carbonyl group or the amino group, it being possible for the amino group to be substituted by $C_1$-$C_4$alkyl which is unsubstituted or further substituted by halogen, hydroxy, cyano, $C_1$-$C_4$alkoxy, $C_1$-$C_4$alkoxycarbonyl, carboxy, sulfamoyl, sulfo or by sulfato. A suitable aliphatic radical is, for example, an alkylene radical having from 1 to 7 carbon atoms, or a branched isomer thereof. The carbon chain of the alkylene radical may be interrupted by a hetero atom, for example an oxygen atom. A suitable aromatic radical is, for example, a phenylene radical which may be substituted by $C_1$-$C_4$alkyl, e.g. methyl or ethyl, $C_1$-$C_4$alkoxy, e.g. methoxy or ethoxy, halogen, e.g. fluorine, bromine or, especially, chlorine, carboxy or by sulfo, and a suitable heterocyclic radical is, for example, a piperazine radical.

Such fibre-reactive radicals Z are known per se and large numbers of them are described, for example in Venkataraman "The Chemistry of Synthetic Dyes" Volume 6, pages 1-209, Academic Press, New York, London 1972 or in EP-A-625 549 and U.S. Pat. No. 5,684,138.

k preferably denotes a number 2 or 3, especially 2.

When k denotes a number 2 or 3, preference is given to at least one of the fibre-reactive radicals Z being a radical from the group of the heterocyclic series, for example a halotriazine radical.

In an especially preferred embodiment of the method according to the invention, there is used a reactive dye of formula (1a)

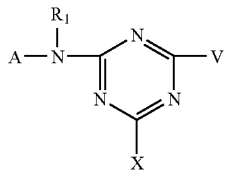

wherein $R_1$ is hydrogen or unsubstituted or substituted $C_1$-$C_4$alkyl,

X is halogen,

A is as defined above, and

V is a non-fibre-reactive substituent or is a fibre-reactive substituent of formula (2a)

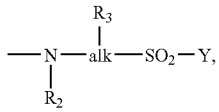

(2b)

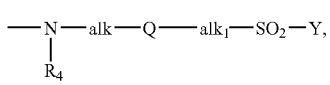

(2c)

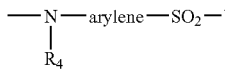

(2d)

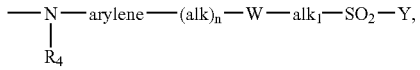

(2e)

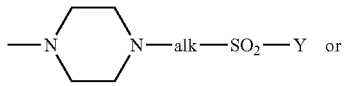

or (2f)

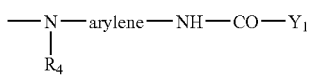

wherein $R_2$ is hydrogen or unsubstituted or substituted $C_1$-$C_4$alkyl or a radical

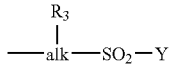

wherein $R_3$ is as defined below, $R_3$ is hydrogen, hydroxy, sulfo, sulfato, carboxy, cyano, halogen, $C_1$-$C_4$alkoxycarbonyl, $C_1$-$C_4$-alkanoyloxy, carbamoyl or a group —$SO_2$—Y, $R_4$ is hydrogen or $C_1$-$C_4$alkyl, alk and $alk_1$ are each independently of the other linear or branched $C_1$-$C_6$alkylene, arylene is a phenylene or naphthylene radical which is unsubstituted or substituted by sulfo, carboxy, hydroxy, $C_1$-$C_4$alkyl, $C_1$-$C_4$alkoxy or by halogen, Y is vinyl or a radical —$CH_2$—$CH_2$—U and U is a leaving group, $Y_1$ is a group —CH(Hal)-$CH_2$(Hal) or —C(Hal)=$CH_2$ wherein Hal is chlorine or bromine, W is a group —$SO_2$—$NR_4$—, —$CONR_4$— or —$NR_4$CO— wherein $R_4$ is as defined above, Q is a radical —O— or —$NR_4$— wherein $R_4$ is as defined above, and n is a number 0 or 1.

If desired, a fibre-reactive radical, for example having the definitions and preferred meanings given above for Z, is bonded to the dye radical A.

In an interesting embodiment of the present invention, either the radical A of the reactive dyes of formula (1a) used according to the invention is substituted by a fibre-reactive radical or the radical V is a fibre-reactive radical of formula (2a), (2b), (2c), (2d), (2e) or (2f). A is preferably not substituted by a fibre-reactive radical.

As $C_1$-$C_4$alkyl for $R_1$, $R_2$ and $R_4$, each independently of the others, there come into consideration, for example, methyl, ethyl, propyl, isopropyl, n-butyl, sec-butyl, tert-butyl and isobutyl, preferably methyl and ethyl, and especially methyl. The mentioned radicals $R_1$ and $R_2$ are unsubstituted or substituted, for example by halogen, hydroxy, cyano, $C_1$-$C_4$alkoxy, $C_1$-$C_4$alkoxycarbonyl, carboxy, sulfamoyl, sulfo or by sulfato, preferably by hydroxy, sulfo, sulfato, carboxy or by cyano. The unsubstituted radicals are preferred.

X is, for example, fluorine, chlorine or bromine, preferably fluorine or chlorine, and especially chlorine.

$R_1$ is preferably hydrogen or $C_1$-$C_4$alkyl, especially hydrogen, methyl or ethyl, and very especially hydrogen.

When Y is a radical —$CH_2$—$CH_2$—U, the leaving group U may be, for example, —Cl, —Br, —F, —$OSO_3H$, —$SSO_3H$, —OCO—$CH_3$, $OPO_3H_2$, —OCO—$C_6H_5$, $OSO_2$—$C_1$-$C_4$alkyl or —$OSO_2$—N($C_1$-$C_4$alkyl)$_2$. U is preferably a group of formula —Cl, —$OSO_3H$, —$SSO_3H$, —OCO—$CH_3$, —OCO—$C_6H_5$ or —$OPO_3H_2$, especially —Cl or —$OSO_3H$, and more especially —$OSO_3H$.

Y is preferably vinyl, β-chloroethyl, β-sulfatoethyl, β-thiosulfatoethyl, β-acetoxyethyl, β-phenoxyethyl or β-phosphatoethyl, especially β-chloroethyl, β-sulfatoethyl or vinyl, more especially β-sulfatoethyl or vinyl, and very especially vinyl.

Hal is preferably bromine.

alk and $alk_1$, each independently of the other, are, for example, methylene, 1,2-ethylene, 1,3-propylene, 1,4-butylene, 1,5-pentylene, 1,6-hexylene or a branched isomer thereof. alk and $alk_1$, each independently of the other, are preferably a $C_1$-$C_4$alkylene radical, and especially an ethylene or propylene radical.

Preferred meanings of arylene are a 1,3- or 1,4-phenylene radical which is unsubstituted or substituted by sulfo, methyl or by methoxy, and especially an unsubstituted 1,3- or 1,4-phenylene radical.

$R_2$ is preferably hydrogen, $C_1$-$C_4$alkyl or a radical of formula

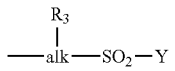

wherein $R_3$, Y and alk in each case are as defined above and have the preferred meanings given above. $R_2$ is especially hydrogen, methyl or ethyl, and very especially hydrogen.

$R_3$ is preferably hydrogen.

$R_4$ is preferably hydrogen, methyl or ethyl, and especially hydrogen.

The variable Q is preferably —NH— or —O—, and especially —O—.

W is preferably a group of formula —CONH— or —NHCO—, especially the group of formula —CONH—.

The variable n is preferably the number 0.

Preferred fibre-reactive substituents V of formulae (2a) to (2f) are those wherein $R_2$ and $R_3$ are each hydrogen, $R_4$ is hydrogen, methyl or ethyl, Q is a radical —NH—or —O—, W is the group —CONH—, alk and alk, are each independently of the other ethylene or propylene, arylene is phenylene which is unsubstituted or substituted by methyl, methoxy or by sulfo, Y is vinyl, βchloroethyl or β-sulfatoethyl, especially vinyl or β-sulfatoethyl, and very especially vinyl, $Y_1$ is —CHBr—$CH_2$Br or —CBr═$CH_2$ and n is the number 0; amongst those substituents special preference is given to the radicals of formulae (2c) and (2d).

When V has the meaning of a fibre-reactive substituent, very special preference is given to V being a group of formula

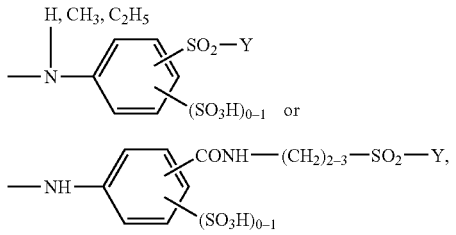

(2c′)

(2d′)

especially (2c'), wherein Y is as defined above and has the preferred meanings given above.

In the radical of formula (2c'), the nitrogen atom can be substituted by methyl or ethyl instead of hydrogen.

An especially important fibre-reactive substituent V is the radical of formula

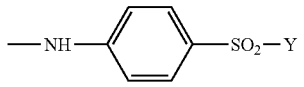

(2c″)

wherein Y is vinyl or β-sulfatoethyl, especially vinyl.

When V is a non-fibre-reactive substituent, it may be, for example, hydroxy; $C_1$-$C_4$alkoxy; $C_1$-$C_4$alkylthio which is unsubstituted or substituted by hydroxy, carboxy or by sulfo; amino; amino mono- or di-substituted by $C_1$-$C_8$alkyl, the alkyl being unsubstituted or further substituted by, for example, sulfo, sulfato, hydroxy, carboxy or by phenyl, especially by sulfo or by hydroxy, and being uninterrupted or interrupted by a radical —O—; cyclohexylamino; morpholino; N—$C_1$-$C_4$alkyl-N-phenylamino or phenylamino or naphthylamino, the phenyl or naphthyl being unsubstituted or substituted by, for example, $C_1$-$C_4$alkyl, $C_1$-$C_4$alkoxy, carboxy, sulfo or by halogen.

Examples of suitable non-fibre-reactive substituents V are amino, methylamino, ethylamino, β-hydroxyethylamino, N,N-di-β-hydroxyethylamino, β-sulfoethylamino, cyclohexylamino, morpholino, o-, m- or p-chlorophenylamino, o-, m- or p-methylphenylamino, o-, m- or p-methoxyphenylamino, o-, m- or p-sulfophenylamino, disulfophenylamino, o-carboxyphenyl -amino, 1- or 2-naphthylamino, 1-sulfo-2-naphthylamino, 4,8-disulfo-2-naphthylamino, N -ethyl-N-phenylamino, N-methyl-N-phenylamino, methoxy, ethoxy, n- or iso-propoxy and hydroxy.

As a non-fibre-reactive radical preference is given to V in the meaning of $C_1$-$C_4$alkoxy, $C_1$-$C_4$-alkylthio which is unsubstituted or substituted by hydroxy, carboxy or by sulfo, hydroxy, amino, N-mono- or N,N-di-$C_1$-$C_4$alkylamino which is unsubstituted or substituted in the alkyl moiety by hydroxy, sulfato or by sulfo, morpholino, phenylamino or N—$C_1$-$C_4$alkyl-N-phenyl-amino (wherein the alkyl is unsubstituted or substituted by hydroxy, sulfo or by sulfato) which is unsubstituted or substituted in the phenyl ring by sulfo, carboxy, chlorine, acetylamino, methyl or by methoxy, or naphthylamino which is unsubstituted or substituted by from 1 to 3 sulfo groups.

Especially preferred non-fibre-reactive radicals V are amino, N-methylamino, N-ethylamino, morpholino, phenylamino, 2-, 3- or 4-sulfophenylamino, naphthylamino, 1-sulfonaphth-2-yl -amino, 3,7-disulfonaphth-2-yl-amino or N—$C_1$-$C_4$alkyl-N-phenylamino.

When A is the radical of a monoazo, polyazo or metal complex azo chromophore, the following radicals, especially, come into consideration:

chromophore radicals of a mono- or dis-azo dye of formula $$D\text{-}N{=}N\text{—}(M\text{-}N{=}N)_u\text{—}K\text{—} \quad (3) \text{ or}$$

$$\text{-}D\text{-}N{=}N\text{—}(M\text{-}N{=}N)_u\text{—}K \quad (4)$$

wherein D is the radical of a diazo component, of the benzene or naphthalene series, M is the radical of a central component, of the benzene or naphthalene series, K is the radical of a coupling component, of the benzene, naphthalene, pyrazolone, 6-hydroxypyrid-2-one or acetoacetic acid arylamide series, and u is a number 0 or 1, wherein D, M and K may carry substituents customary for azo dyes, for example $C_1$-$C_4$alkyl or $C_1$-$C_4$alkoxy each of which is unsubstituted or further substituted by hydroxy, sulfo or by sulfato, halogen, carboxy, sulfo, nitro, cyano, trifluoromethyl, sulfamoyl, carbamoyl, amino, ureido, hydroxy, carboxy, sulfo-methyl, $C_2$-$C_4$alkanoylamino, benzoylamino which is unsubstituted or substituted in the phenyl ring by $C_1$-$C_4$alkyl, $C_1$-$C_4$alkoxy, halogen or by sulfo, phenyl which is unsubstituted or substituted by $C_1$-$C_4$alkyl, $C_1$-$C_4$alkoxy, halogen, carboxy or by sulfo, and also fibre-reactive radicals. There also come into consideration the metal complexes derived from the dye radicals of formulae (3) and (4), especially dye radicals of a 1:1 copper complex azo dye or 1:2 chromium complex azo dye, of the benzene or naphthalene series, wherein the copper or chromium atom is in each case bonded, on each side in the position ortho to the azo bridge, to a group capable of being metallated.

When the chromophore radicals of formula (3) or (4) carry a reactive radical, the reactive radical may correspond, for example, to formula $$-SO_2-Y, \quad (5a)$$

$$-CONH-(CH_2)_m-SO_2-Y, \quad (5b)$$

$$-CONH-(CH_2)_l-O-(CH_2)_m-SO_2-Y, \quad (5c)$$

$$-NHCO-(CH_2)_m-SO_2-Y, \quad (5d)$$

$$-(O)_p-(CH_2)_q-CONH-(CH_2)_m-SO_2-Y, \quad (5e)$$

$$-NH-CO-CH(Hal)-CH_2(Hal), \quad (5f)$$

$$-NH-CO-C(Hal)=CH_2 \quad \text{or} \quad (5g)$$

(5h)

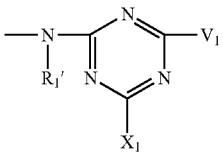

wherein Y and Hal each are as defined above and have the preferred meanings given above, $V_1$ independently has the definitions and preferred meanings given above for V, $X_1$ independently has the definitions and preferred meanings given above for X, $R_1'$ independently has the definitions and preferred meanings given above for $R_1$, and p is a number 0 or 1, and l, m and q are each independently of the others an integer from 1 to 6. Preferably, p is the number 0, I and m are each independently of the other a number 2 or 3, and q is a number 1, 2, 3 or 4.

As reactive radicals for the chromophore radicals of formula (3) or (4) there comes into consideration, especially, a radical of formula (5a), (5d), (5f), (5g) or (5h) given above, especially of formula (5a) or (5h).

Preferably, the chromophore radicals A of formula (3) or (4) do not carry a reactive radical.

Especially preferred radicals of a monoazo or disazo chromophore A are the following:

(6a)

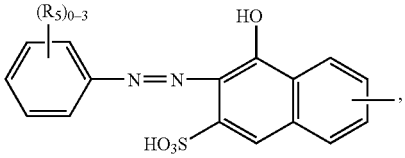

(6b)

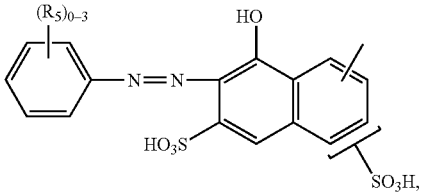

-continued (6c)

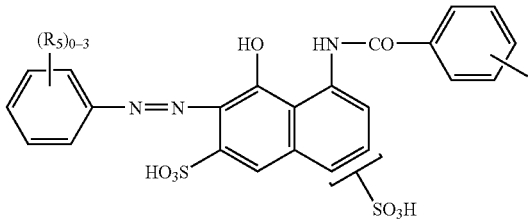

wherein $(R_5)_{0-3}$ denotes from 0 to 3 identical or different substituents from the group $C_1$-$C_4$alkyl, $C_1$-$C_4$alkoxy, halogen, carboxy and sulfo, (6d)

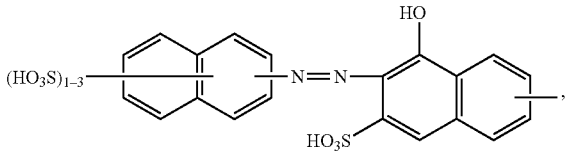

(6e)

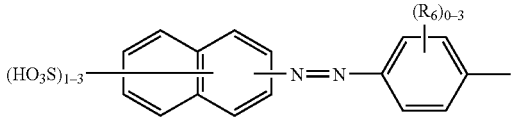

wherein $(R_6)_{0-3}$ denotes from 0 to 3 identical or different substituents from the group halogen, nitro, cyano, trifluoromethyl, sulfamoyl, carbamoyl, $C_1$-$C_4$alkyl, $C_1$-$C_4$alkoxy, amino, $C_2$-$C_4$-alkanoylamino, ureido, hydroxy, carboxy, sulfomethyl and sulfo, (6f)

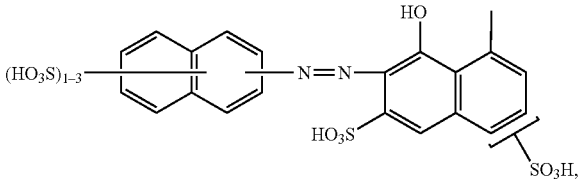

(6g)

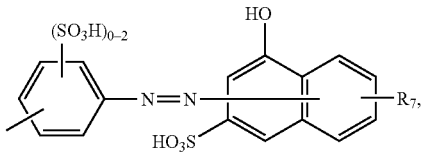

(6h)

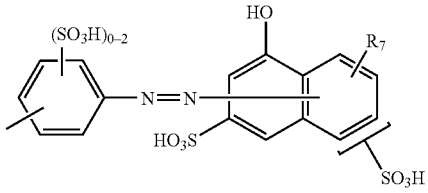

wherein $R_7$ is amino, $C_1$-$C_4$alkylamino, $C_2$-$C_4$alkanoylamino, benzoylamino or a reactive radical of formula (5d) or (5h) given above, (6i)

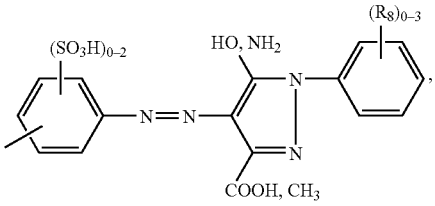

(6j)

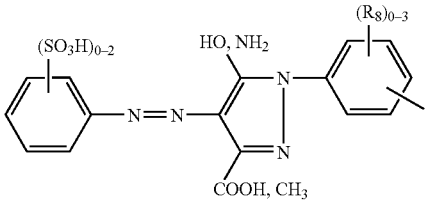

wherein $(R_8)_{0-3}$ denotes from 0 to 3 identical or different substituents from the group $C_1$-$C_4$alkyl, $C_1$-$C_4$alkoxy, halogen, carboxy and sulfo, (6k)

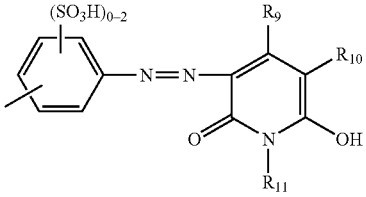

wherein $R_9$ and $R_{11}$, are each independently of the other hydrogen, $C_1$-$C_4$alkyl or phenyl and $R_{10}$ is hydrogen, cyano, carbamoyl or sulfomethyl, (6l)

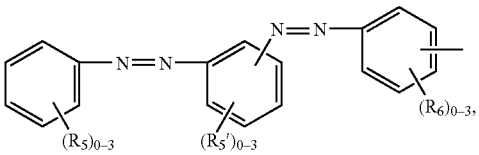

(6m)

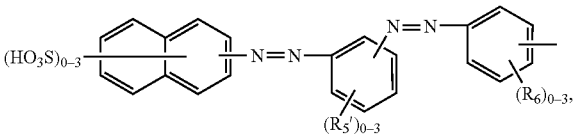

(6n)

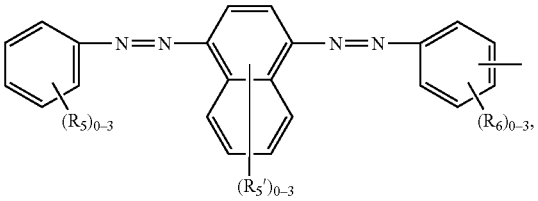

-continued (6o)

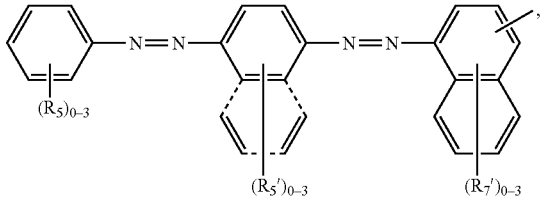

(6p)

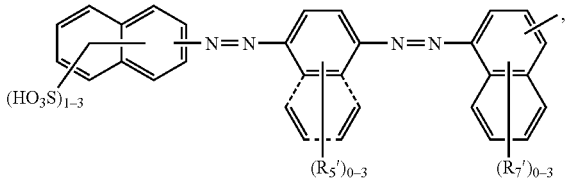

(6q)

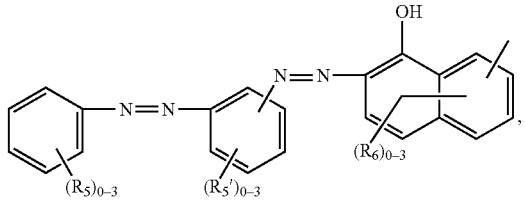

(6r)

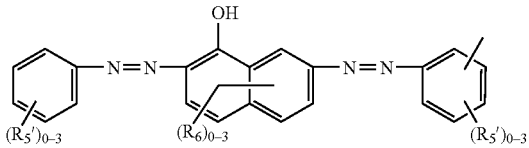

or (6s)

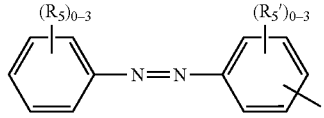

wherein $(R_5)_{0-3}$ and $(R_6)_{0-3}$ are as defined above, $(R_5')_{0-3}$ denotes from 0 to 3 identical or different substituents from the group $C_1$-$C_4$alkyl, $C_1$-$C_4$alkoxy, $C_2$-$C_4$alkanoylamino, ureido, halogen, carboxy, sulfo, $C_1$-$C_4$hydroxyalkoxy and $C_1$-$C_4$sulfatoalkoxy, and $(R_7')_{0-3}$ denotes from 0 to 3 identical or different substituents from the group $C_1$-$C_4$alkyl, $C_1$-$C_4$alkoxy, halogen, carboxy and sulfo, and Y is as defined above.

The radicals of formulae (6a), (6b), (6c), (6d), (6e), (6f, (6i), (6j), (6l), (6m), (6n), (6o), (6p), (6q), (6r) and (6s) may also contain, as a further substituent, in the phenyl or naphthyl rings, a fibre-reactive radical of formula (5a), (5b), (5c), (5d), (5e), (5f) or (5g) wherein the variables are as defined above and have the preferred meanings given above. Preferably, they do not contain a fibre-reactive radical.

The radical of a formazan dye A is preferably a dye radical of formula (7a)

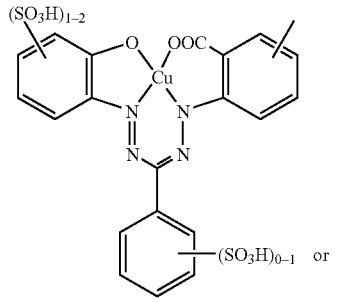

(7b)

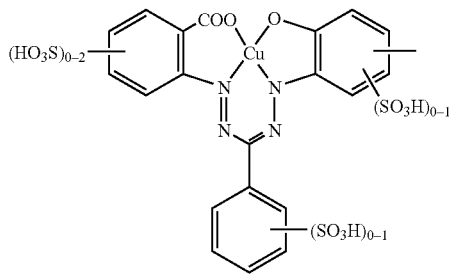

wherein the benzene nuclei contain no further substituents or are further substituted by $C_1$-$C_4$alkyl, $C_1$-$C_4$alkoxy, $C_1$-$C_4$alkylsulfonyl, halogen or by carboxy.

When A is the radical of a phthalocyanine dye, it is preferably a radical of formula (8)

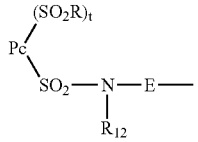

wherein Pc is the radical of a metal phthalocyanine, especially the radical of a copper or nickel phthalocyanine; R is —OH and/or —$NR_{13}R_{14}$; $R_{13}$ and $R_{14}$ are each independently of the other hydrogen or $C_1$-$C_4$alkyl which is unsubstituted or substituted by hydroxy or by sulfo; $R_{12}$ is hydrogen or $C_1$-$C_4$alkyl; E is a phenylene radical which is unsubstituted or substituted by $C_1$-$C_4$alkyl, halogen, carboxy or by sulfo or is a $C_2$-$C_6$alkylene radical; and t is 1 to 3. $R_{13}$ and $R_{14}$ are preferably hydrogen. E is preferably a phenylene radical which is unsubstituted or substituted by $C_1$-$C_4$alkyl, halogen, carboxy or by sulfo. Pc is preferably the radical of a copper phthalocyanine.

When A is the radical of a dioxazine dye, it is, for example, a radical of formula (9)

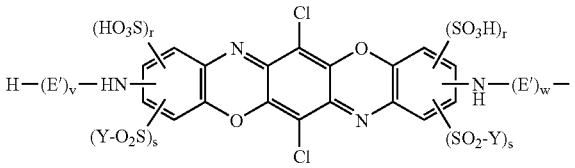

wherein E' is a phenylene radical which is unsubstituted or substituted by $C_1$-$C_4$alkyl, halogen, carboxy or by sulfo or is a $C_2$-$C_6$alkylene radical, r, s, v and w are each independently of the others a number 0 or 1, and Y is as defined above. Preferably, E' is $C_2$-$C_4$alkylene or is 1,3- or 1,4-phenylene which is unsubstituted or substituted by sulfo, r is the number 1, s is the number 0, v is the number 1, and w is a number 0 or 1.

When A is the radical of an anthraquinone dye, it is preferably a radical of formula (10)

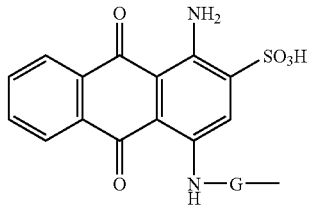

wherein G is a phenylene radical which is unsubstituted or substituted by $C_1$-$C_4$alkyl, $C_1$-$C_4$alkoxy, halogen, carboxy or by sulfo or is a cyclohexylene, phenylenemethylene or $C_2$-$C_6$alkylene radical, the anthraquinone dye radical of formula (10) preferably containing at least 2 sulfo groups. G is preferably a phenylene radical which is unsubstituted or substituted by $C_1$-$C_4$alkyl, $C_1$-$C_4$alkoxy, halogen, carboxy or by sulfo.

Special preference is given to A being a monoazo or disazo chromophore radical of formula (6a), (6b), (6d), (6e), (6f), (6g), (6h), (6i), (6j), (6k), (6m), (6o), (6r) or (6s) given above, a formazan radical of formula (7b) given above, or an anthraquinone radical of formula (10) given above, especially of formula (6a), (6b), (6e), (6g), (6h), (6i), (6j), (6k), (6m), (6s) or (10).

In the meanings given for the variables, $C_1$-$C_4$alkyl is generally methyl, ethyl, n- or iso-propyl or n-, iso-, sec- or tert-butyl. $C_1$-$C_4$Alkoxy is generally methoxy, ethoxy, n- or iso-propoxy or n-, iso-, sec- or tert-butoxy. Halogen is generally, for example, fluorine, chlorine or bromine. Examples of $C_2$-$C_4$alkanoylamino are acetylamino and propionylamino. Examples of $C_1$-$C_4$hydroxyalkoxy are hydroxymethoxy, β-hydroxyethoxy and β- and γ-hydroxypropoxy. Examples of $C_1$-$C_4$sulfatoalkoxy are sulfatomethoxy, β-sulfatoethoxy and β- and γ-sulfatopropoxy. Examples of $C_1$-$C_4$alkylsulfonyl are methylsulfonyl, ethylsulfonyl and propylsulfonyl.

For the method according to the invention preference is given to the use of dyes of formula (1a) wherein $R_1$, X and A are as defined above and have the preferred meanings given above and V is a fibre-reactive substituent of formula (2a), (2b), (2c), (2d), (2e) or (2f) wherein $R_2$, $R_3$, $R_4$, alk, $alk_1$, arylene, Y, $Y_1$, W, Q and n are each as defined above and have the preferred meanings given above.

The reactive dyes of formula (1) contain at least one, preferably at least two, sulfo group(s), which is/are either in the form of the free acid or, preferably, in the form of a salt thereof. Suitable salts are, for example, the alkali metal, alkaline earth metal or ammonium salts, salts of an organic amine or mixtures thereof. As examples there may be mentioned sodium, lithium, potassium or ammonium salts, the salt of mono-, di- or tri-ethanolamine or Na/Li or Na/Li/$NH_4$ mixed salts.

Dyes that are suitable for the method according to the invention correspond, for example, to formulae (1.1)
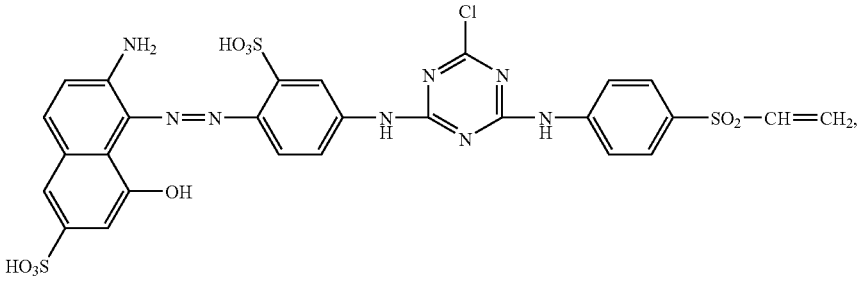
(1.2)
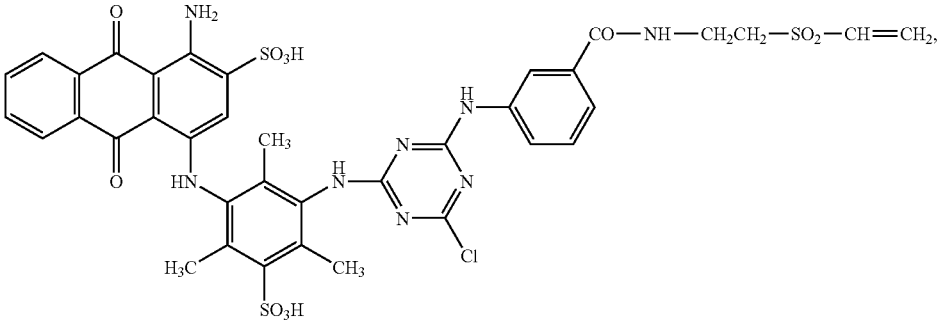
(1.3)
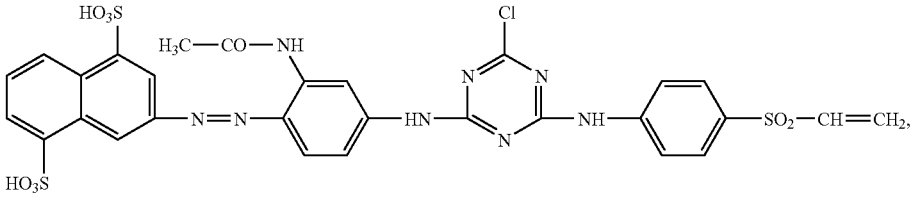
(1.4)
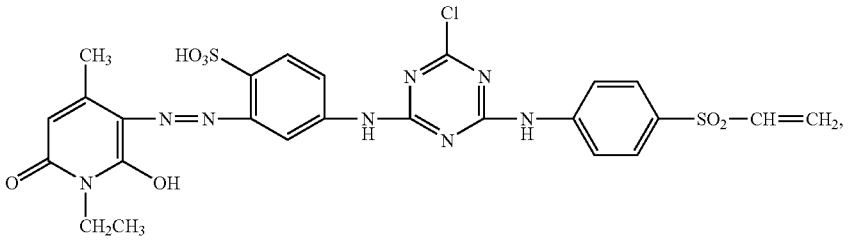
(1.5)
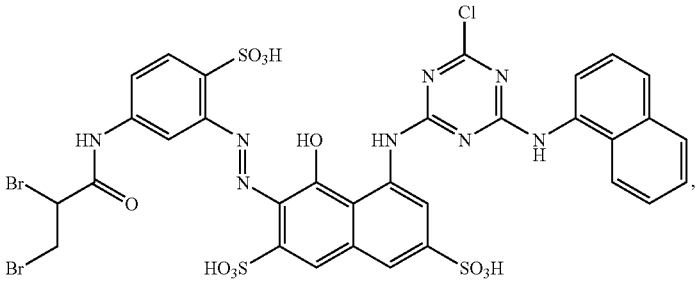

-continued
(1.6)
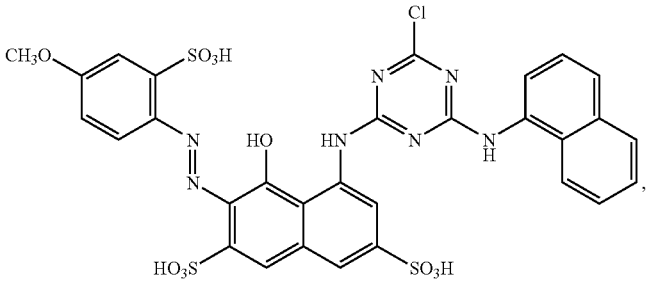
(1.7)
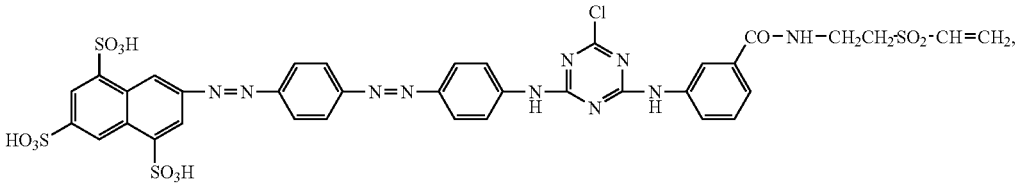
(1.8)
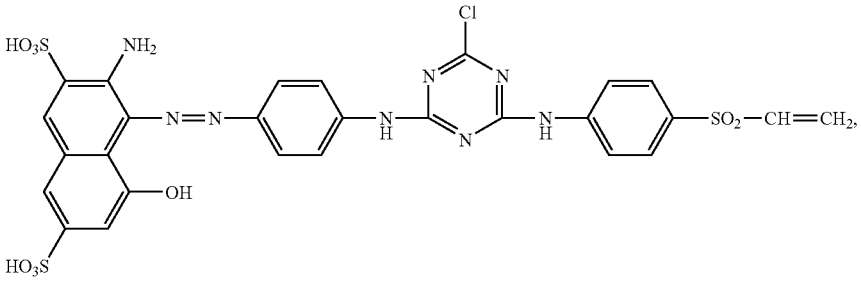
(1.9)
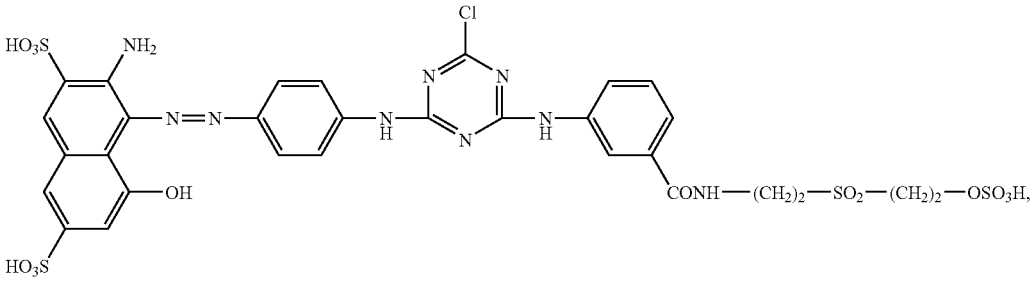
(1.10)
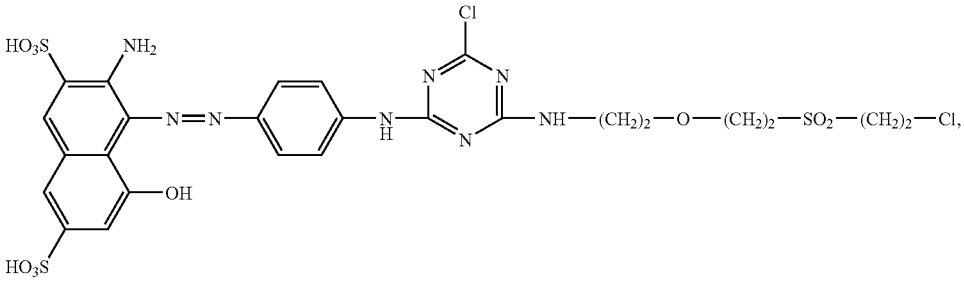
(1.11)
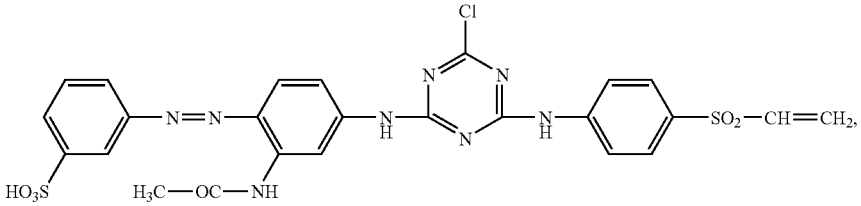

-continued
(1.12)
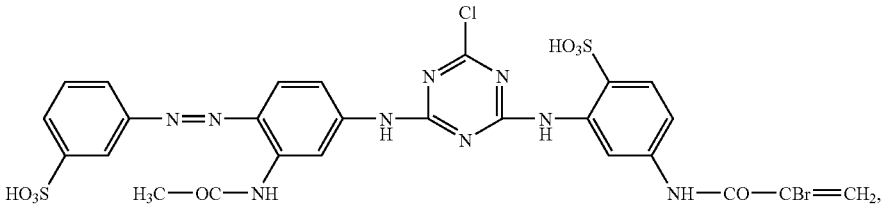
(1.13)
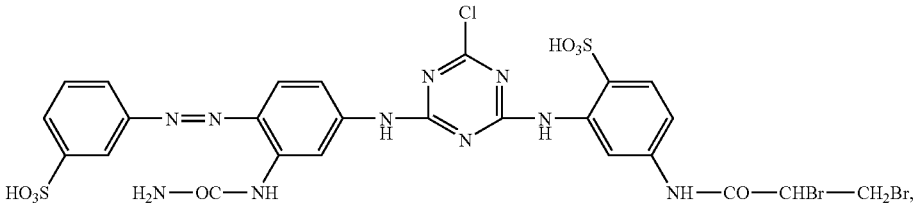
(1.14)
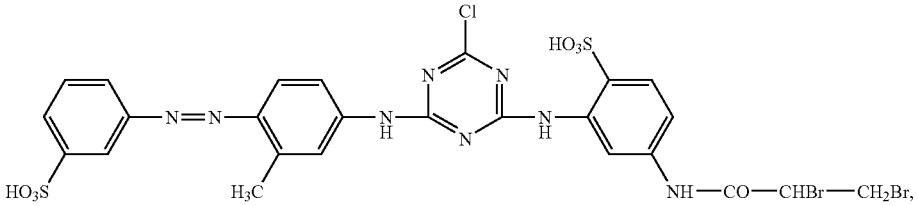
(1.15)
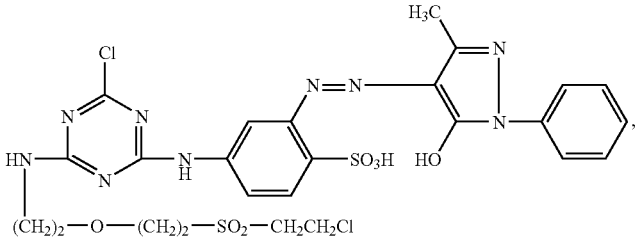
(1.16)
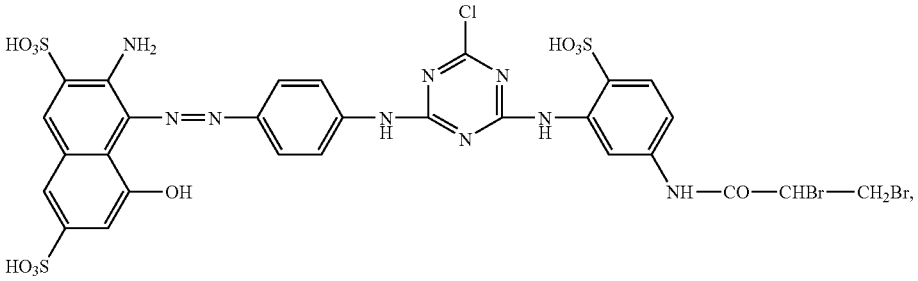
(1.17)
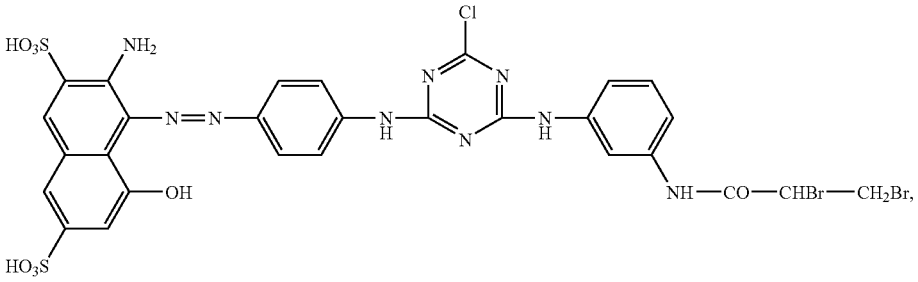

-continued
(1.18)
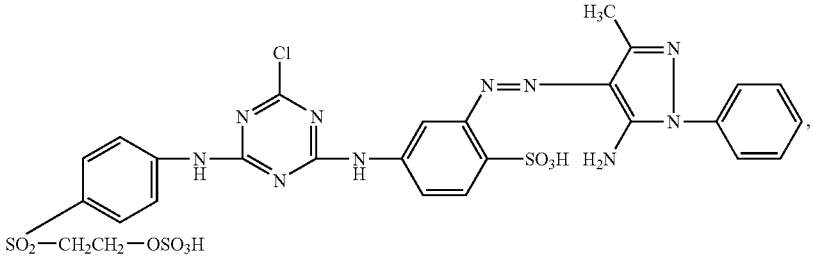
(1.19)
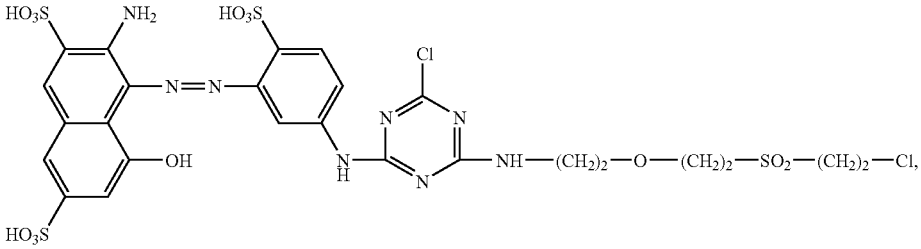
(1.20)
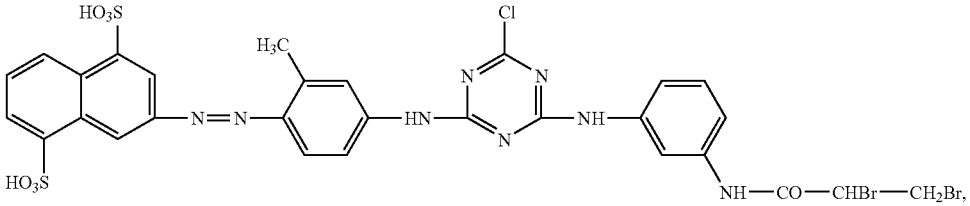
(1.21)
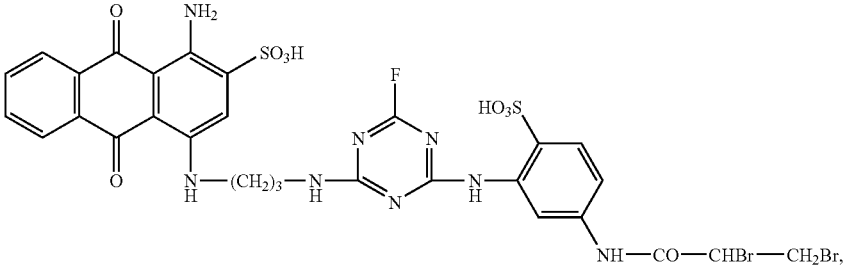
(1.22)
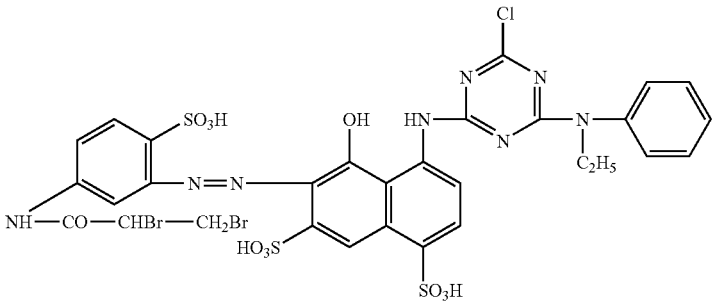
and -continued (1.23)

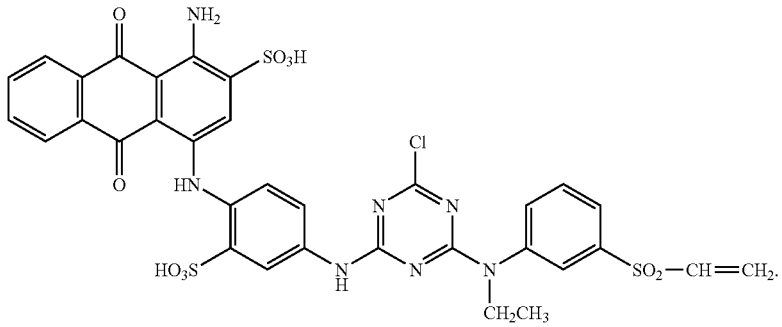

The reactive dyes used in the method according to the invention may comprise further additives such as, for example, sodium chloride or dextrin.

The dyes used in accordance with the invention are known or can be prepared using methods known per se, such as those described, for example, in U.S. Pat. Nos. 5,760,194, 5,760,195, 5,779,740 and EP-A-1 247 841.

For the method according to the invention, the customary dyeing or printing methods may be used. The dye liquors or printing pastes may comprise, in addition to water and the dyes, further additives, for example wetting agents, antifoams, levelling agents or agents that influence the characteristics of the textile material, for example softeners, flame-retardant additives, or dirt-, water- and oil-repellents, and also water-softeners and natural or synthetic thickeners, for example alginates and cellulose ethers.

The amounts in which the individual dyes are used in the dye baths or printing pastes can vary within wide limits depending on the required depth of shade; in general, amounts of from 0.01 to 15% by weight, especially from 0.1 to 10% by weight, based on the material to be dyed or the printing paste, have proved to be advantageous.

The dyes may be used singly, or mixtures of dyes, for example mixtures of two or three dyes (di- or tri-chromism), may be used.

Suitable compounds which reduce the ionic character of the anionic group, that is to say which reduce the solubility product of the dye in the aqueous dye liquor, are, for example, alkaline earth metal salts, transition metal salts and aluminium salts.

In this context, although the term salt also includes oxides and hydroxides, hydroxides and carbonates are preferably not used in the method according to the invention.

There may be mentioned, by way of example, salts of polyvalent metals such as $Mg^{2(+)}$, $Ca^{2(+)}$, $Sr^{2(+)}$, $Ba^{2(+)}$, $Mn^{2(+)}$, $Cu^{2(+)}$, $Zn^{2(+)}$, $Ni^{2(+)}$, $Cd^{2(+)}$, $Co^{3(+)}$, $Al^{3(+)}$, $Sn^{2(+)}$ and $Cr^{3(+)}$ salts, e.g. in the form of a chloride, sulfate, nitrate, acetate, formate, tartrate or lactate, preferably in the form of a chloride, sulfate or nitrate and especially in the form of a chloride.

Preference is given to $Ca^{2(+)}$, $Ba^{2(+)}$ and $Al^{3(+)}$ salts, especially $Ca^{2(+)}$ salts.

Special preference is given to the use of $CaCl_2$.

Suitable nucleophilic compounds are compounds which are capable of reacting with the fibre-reactive groups of the reactive dyes in an addition or substitution reaction, e.g. aliphatic or aromatic compounds containing at least one amino, mercapto or hydroxy group. The term amino group in the present case includes both primary and secondary amino groups which are capable of entering into an addition or substitution reaction with fibre-reactive groups.

Preference is given to compounds containing at least one amino group, for example two or three amino groups.

Suitable aromatic amines are, for example, anilines or aminonaphthalenes. The mentioned anilines or aminonaphthalenes also include compounds substituted at the nitrogen by, for example, $C_1$-$C_4$alkyl and are unsubstituted or substituted at the aromatic moiety by, for example, $C_1$-$C_{18}$alkyl, $C_1$-$C_{18}$alkoxy, carboxy, carbamoyl, N—$C_1$-$C_{18}$alkylcarbamoyl, sulfo, hydroxy or by halogen.

Suitable aromatic amines also include those containing two amino groups such as, for example, compounds of formula $$H_2N—B—NH_2 \quad (11),$$

wherein B is unsubstituted or $C_1$-$C_4$alkyl-, $C_1$-$C_4$alkoxy-, $C_2$-$C_4$alkanoylamino-, sulfo-, halo- or carboxy-substituted $C_1$-$C_6$alkylenephenylene, e.g. methylenephenylene, or unsubstituted or similarly substituted naphthylene or phenylene, or a radical of formula (12)

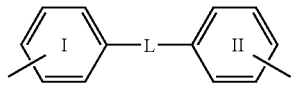

wherein the benzene rings I and II are unsubstituted or substituted by $C_1$-$C_4$alkyl, $C_1$-$C_4$-alkoxy, $C_2$-$C_4$alkanoylamino, sulfo, halogen or by carboxy and L is a direct bond or a $C_1$-$C_{10}$-alkylene radical which, with the exception of methylene, may be interrupted by 1, 2 or 3 oxygen atoms, or L is a bridging member of formula —CH═CH—, —NH—, —CO—, —NH—CO—, —NH—$SO_2$—, —NH—CO—NH—, —O—, —S— or —$SO_2$—. The aromatic bridging members mentioned for B are preferably unsubstituted or substituted by sulfo. There may be mentioned, by way of example: phenylenediamine, toluylenediamine, xylylenediamine and 4,4'-diaminodiphenyl-methane.

The two amino groups in the compound of formula (11) may be further substituted by one substituent, for example by $C_1$-$C_4$alkyl which may in turn be substituted by, for example, $C_2$-$C_4$alkanoylamino, e.g. acetylamino or propionylamino; $C_1$-$C_4$alkoxy, e.g. methoxy or ethoxy; hydroxy; sulfo; sulfato; carboxy; carbamoyl or by sulfamoyl.

Suitable aliphatic amines are, for example, $C_{10}$-$C_{20}$terpeneamines, preferably $C_{20}$diterpeneamines, that is to say an amino group monosubstituted by a terpene hydrocarbon radical. Suitable terpene hydrocarbon radicals are, for example, acyclic, monocyclic or bicyclic $C_{10}$terpenes, acyclic, monocyclic, bicyclic or tricyclic $C_{15}$sesqui-terpenes, acyclic, monocyclic or tricyclic $C_{20}$diterpenes, especially tricyclic $C_{20}$diterpenes and very especially dehydrogenated tricyclic $C_{20}$diterpenes, for example those which are derived from dehydroabietic acid. An example of such a dehydrogenated tricyclic $C_{20}$diterpeneamine is the compound of formula (13)

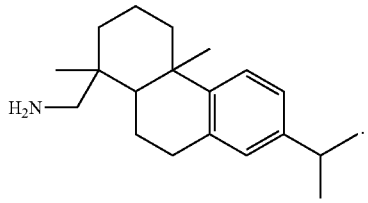

Suitable aliphatic amines also include, for example, N-mono- or N,N-di-$C_1$-$C_{24}$alkylamines, e.g. methylamine, ethylamine, N,N-dimethylamine, N,N-diethylamine, isopropylamine, n-butylamine, sec-butylamine, isobutylamine or tert-butylamine, linear or branched pentylamine, hexylamine, heptylamine, octylamine, nonylamine, decylamine, undecylamine, dodecylamine, tridecylamine or tetradecylamine. The mentioned amines are unsubstituted or substituted in the alkyl moiety, for example by phenyl which may in turn be substituted by $C_1$-$C_{18}$alkyl, $C_1$-$C_{18}$alkoxy, halogen, carboxy, carbamoyl, sulfo or by sulfamoyl; $C_2$-$C_{18}$-alkanoylamino, e.g. acetylamino or propionylamino; $C_1$-$C_{18}$alkoxy, e.g. methoxy or ethoxy; hydroxy; sulfo; sulfato; carboxy; carbamoyl or by sulfamoyl. The mentioned radicals are uninterrupted or interrupted in the alkyl moiety by oxygen or by —$NR_{15}$—, wherein $R_{15}$ is hydrogen, methyl or ethyl, preferably hydrogen.

Suitable aliphatic amines also include those containing two amino groups, e.g. aliphatic diamines of formula (11) wherein B is $C_1$-$C_4$alkylenephenylene-$C_1$-$C_4$alkylene, e.g. methylenephenylenemethylene, or a $C_2$-$C_{24}$alkylene radical which is unsubstituted or substituted by hydroxy, sulfo, sulfato, cyano or by carboxy and which may be interrupted by from 1 to 12 moieties, e.g. 1, 2, 3 or 4 moieties, from the group oxygen and —$NR_{15}$—, wherein $R_{15}$ is hydrogen, methyl or ethyl, preferably hydrogen. Preferred substituents of the alkylene radicals mentioned for B are hydroxy, sulfo or sulfato, especially hydroxy. By way of example there may be mentioned: 1,2-ethylenediamine, 1,3-propylenediamine, 1,4-butylenediamine, 1,5-pentamethylenediamine or 1,6-hexamethylenediamine, 3-amino-1-methylaminopropane, N-hydroxyethylethylenediamine, N-methyl-bis(3-aminopropyl)amine, tetraethylenediamine, 1-aminoethyl-1,2-ethylenediamine, diethylenetriamine, tetraethylenepentamine and pentaethylenehexamine, especially 1,6-hexamethylenediamine.

Also suitable are relatively high molecular weight polyamines such as, for example, polyethyleneimines containing more than 24 carbon atoms or polyvinylamine.

Suitable aliphatic amines also include compounds containing three or more than three primary amino groups, e.g. tris(2-aminoethyl)amine.

Suitable aliphatic amines also include, for example, aliphatic diamines of formula (11) wherein B is $C_5$-$C_9$cycloalkylene, e.g. cyclohexylene. The mentioned cycloalkylene radical may be unsubstituted or substituted by $C_0$-$C_4$alkyl, $C_1$-$C_4$alkoxy, $C_2$-$C_4$alkanoylamino, sulfo, halogen or by carboxy, especially by $C_1$-$C_4$alkyl. Also suitable for B are methylene-cyclohexylene, ethylene-cyclohexylene and methylene-cyclohexylene-methylene radicals unsubstituted or substituted in the cyclohexylene ring by $C_1$-$C_4$alkyl, especially by methyl, and the isophorone radical and the hydrogenated diphenylmethane radical. By way of example there may be mentioned: 1,4-diaminocyclohexane, isophoronediamine, hydrogenated xylylenediamine and hydrogenated 4,4'-diaminodiphenylmethane.

An aromatic amine is understood to be a compound wherein the nitrogen atom of the amino group is directly bonded to an aromatic carbon atom. Accordingly, the term aliphatic amine is understood to refer to a compound wherein the nitrogen atom of the amino group is directly bonded to an aliphatic carbon atom. In the method according to the invention, preference is given to the use of aliphatic amines as the nucleophilic compound, especially those containing at least two amino groups.

Preferred nucleophilic compounds are the aliphatic diamines of formula (11).

Especially preferred nucleophilic compounds are compounds of formula (11) wherein B is a $C_2$-$C_{12}$alkylene radical, especially a $C_2$-$C_6$alkylene radical, which may be interrupted by 1, 2 or 3 —O— moieties and which is unsubstituted or substituted by hydroxy or by sulfato. Of special importance are compounds of formula (11) wherein B is a $C_2$-$C_6$alkylene radical which is unsubstituted and is not interrupted by —O—.

Advantageously, (b) and (c), that is to say treatment of the textile fibre material with the salt and treatment of the textile fibre material with the nucleophilic compound, are carried out one after the other.

Treatment of the textile fibre material with the salt (b) is advantageously carried out by first dyeing the fibre material in customary manner and then adding the salt in suitable form, e.g. in the form of an aqueous solution, to the dye liquor during the dyeing process, for example after a dyeing period of from 10 to 60 minutes, especially from 10 to 30 minutes, followed, where appropriate, by a further period of dyeing of, for example, from 10 to 60 minutes, especially from 20 to 50 minutes.

(b) can also be carried out by treating, for example impregnating, the textile fibre material with the salt before the dyeing or printing process, it being unimportant which technique is used to introduce the salt into the fibre material; for example, spray or foam application, immersion or a pad can be used. Dyeing or printing with the reactive dye according to (a) can be carried out thereafter. It is then unnecessary to add further salt during the dyeing or printing process.

Treatment of the textile fibre material with the nucleophilic compound (c) can be carried out directly in the dye liquor by adding the nucleophilic compound in suitable form, e.g. in the form of an aqueous solution, or preferably in a separate after-treatment bath. When carrying out (c) in a separate after-treatment bath, the dyed material is removed from the dye liquor after the actual dyeing process and after the performance of (b) and, where appropriate, is rinsed again in suitable manner before being introduced into the after-treatment liquor.

When (c) is carried out in a separate after-treatment bath, the treatment with the nucleophilic compound is performed at a temperature of, for example, from 30 to 100° C. and especially from 50 to 80° C.

The compounds which reduce the ionic character of the anionic group are advantageously used in an amount of, for example, from 0.1 to 100% by weight, preferably from 0.5 to 50% by weight and especially from 2 to 40% by weight, based on the weight of the substrate, that is to say the textile fibre material.

The nucleophilic compound is advantageously used in an amount of, for example, from 0.001 to 2% by weight, especially from 0.01 to 1% by weight, based on the weight of the dye liquor or on the weight of the after-treatment bath.

The method according to the invention is suitable, for example, for dyeing or printing hydroxyl-group-containing or nitrogen-containing fibre materials. By way of example there may be mentioned silk, wool, cellulosic fibre materials of all kinds and polyurethanes and polyamide fibres. Cellulosic fibre materials are, for example, the natural cellulosic fibres, such as cotton, linen and hemp, and also cellulose and regenerated cellulose. The method according to the invention is also suitable for dyeing or printing hydroxylgroup-containing fibres present in blend fabrics, e.g. mixtures of cotton with polyester fibres or polyamide fibres. In a particular embodiment, the method according to the invention is not used for cellulosic or silk-containing fibre materials such as, for example, cellulose or silk.

Preferably, the method according to the invention is suitable for dyeing or printing synthetic polyamide fibre materials, such as, for example, polyamide-6 (poly-ϵ-caprolactam), polyamide-6.6 (poly(hexamethylene adipamide)), polyamide-7, polyamide-6.12 (poly(hexamethylene dodecanoamide)), polyamide-11 or polyamide-12, copolyamides with polyamide6.6 or polyamide-6, for example polymers of hexamethylenediamine, ϵ-caprolactam and adipic acid and polymers of adipic acid, hexamethylenediamine and isophthalic acid or of adipic acid, hexamethylenediamine and 2-methylpentamethylene-diamine or 2-ethyltetramethylenediamine, and is also suitable for dyeing or printing blend fabrics or yams of synthetic polyamide and wool.

The method according to the invention is advantageously also suitable for dyeing or printing microfibres of synthetic polyamides. Microfibres are understood to be fibre materials that are composed of filaments having an individual filament fineness of less than 1 denier (1.1 dTex). Such microfibres are known and are usually produced by melt-spinning.

In order to improve further the fastness properties of synthetic polyamides, especially microfibres, the dyeing process according to the invention can be followed by customary after-fixing or alkaline after-treatment.

The mentioned textile material can be in a very wide variety of processing forms, such as, for example, in the form of fibres, yarn, woven fabric, knitted fabric and in the form of carpets.

In the case of carpet fabrics, printing methods such as, for example, displacement printing, or space dyeing are of importance.

Preference is given to dyeing which is especially carried out in accordance with the exhaust method and, in the case of carpet dyeing, may also be carried out in accordance with the continuous method.

Preference is given to dyeing at a pH of from 2 to 7, especially from 2.5 to 5.5, and very especially from 3 to 4.5. The liquor ratio can be selected within a wide range, e.g. from 1:5 to 1:50, preferably from 1:5 to 1:30. Preference is given to dyeing at a temperature of from 80 to 130° C., especially from 85 to 120° C.

Dyeings and printings with good all-round fastness properties, such as, for example, good fastness to chlorine, rubbing, wetting, wet-rubbing, washing, water, sea-water and perspiration, are obtained. Contact fastness properties especially, such as, for example, fastness to water and perspiration, exhibit very good values.

The Examples given hereinbelow are intended to illustrate the invention without limiting the invention to the Examples specifically mentioned. The temperatures are given in degrees Celsius, parts are parts by weight and percentages refer to % by weight, unless otherwise specified. Parts by weight relate to parts by volume in the same ratio as kilograms to litres.

EXAMPLE 1

70 g of a blend fabric consisting of 72% polyamide microfibres and 28% elastane are treated in a dyeing apparatus with 1.5 litres of liquor containing 3 g of formic acid, 0.4 g of wetting agent and 0.7 of a levelling agent, for 10 minutes at 40° C. The pH of the liquor is 2.9. 5.8 g of the dye of formula (1.5), previously dissolved in a small amount of water, are then added. The material to be dyed is treated in the dye liquor at 40° C. for 5 min and is then heated to 100C and dyed for 20 min at that temperature. 14 g of calcium chloride are then added and dyeing is continued for 40 min. After dyeing, the material is treated with 1.5 litres of an after-treatment bath containing 2 g of 1,6-hexamethylenediamine for 20 minutes at 70° C. Rinsing and finishing are then carried out in customary manner. A deep, level dyeing having good fastness properties is obtained.

In order to improve the fastness properties further, customary after-fixing or alkaline after-treatment may follow. For alkaline after-treatment, the dyeing is treated in a fresh bath, which contains 2 g/l of soda and has a pH of 9.2, for 20 minutes at 60° C.

The depth of shade of the dyeing is approximately three times that of a comparison dyeing carried out analogously to Example 1 but omitting the treatment with $CaCl_2$ and 1,6-hexamethylenediamine.

EXAMPLE 2

70 g of a fabric of polyamide6.6 microfibres are treated in a dyeing apparatus with 1.5 litres of liquor containing 3 g of formic acid, 0.4 g of wetting agent and 0.7 g of a levelling agent, for 10 min at 40° C. The pH of the liquor is 2.9. 6.6 g of the dye of formula (1.23), previously dissolved in a small amount of water, are then added. The material to be dyed is treated in the dye liquor at 40° C. for 5 min and is then heated to 100° C. and dyed for 20 min at that temperature. 14 g of calcium chloride, previously dissolved in 70 g of water, are then added and dyeing is continued for 40 min. After dyeing, the material is treated with 1.5 litres of an after-treatment bath containing 2 g of 1,6-hexamethylenediamine for 20 minutes at 70° C. Rinsing and finishing are then carried out in customary manner. A deep, level dyeing having excellent fastness properties is obtained. The depth of shade of the dyeing is approximately twice that of a comparison dyeing carried out analogously to Example 2 but omitting the treatment with $CaCl_2$ and 1,6-hexamethylenediamine.

By proceeding as described in Example 1 but using, instead of 5.8 g of the dye of formula (1.5), the same amount of the dye of formula (1.1), (1.2), (1.3), (1.4), (1.6), (1.7), (1.8), (1.9), (1.10), (1.11), (1.12), (1.13), (1.14), (1.15), (1.16), (1.17), (1.18), (1.19), (1.20), (1.21) or (1.22), a deep, level dyeing having very good fastness properties is likewise obtained.

The invention claimed is:

1. A method of dyeing or printing textile fibre materials, which comprises bringing the fibre material into contact with (a) an anionic group containing reactive dye of formula (1.5)

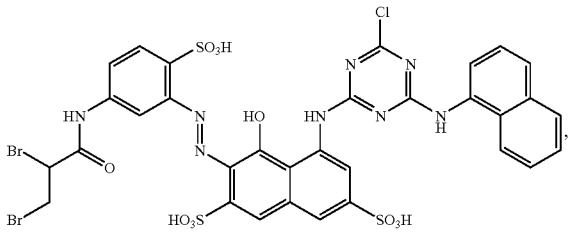

(b) at least one compound which reduces the ionic character of the anionic group which is an $Mg^{2(+)}$, $Ca^{2(+)}$, $Sr^{2(+)}$, $Ba^{2(+)}$, $Mn^{2(+)}$, $Cu^{2(+)}$, $Zn^{2(+)}$, $Ni^{2(+)}$, $Cd^{2(+)}$, $Co^{3(+)}$, $Al^{3(+)}$, $Sn^{2(+)}$ or $Cr^{3(+)}$ salt in the form of a chloride, sulfate, nitrate, acetate, formate, tartrate or lactate, and (c) at least one nucleophilic compound of formula $$H_2N—B—NH_2 \quad (11),$$

wherein B is a $C_2$-$C_{12}$ alkylene radical which may be interrupted by 1, 2 or 3 —O— moieties and which is unsubstituted or substituted by hydroxy or by sulfato.

2. A method according to claim 1, wherein treatment of the fibre material with the nucleophilic compound is carried out in a separate after-treatment bath at a temperature of from 30 to 100° C.

3. A method according to claim 1, wherein the compound which reduces the ionic character of the anionic group is used in an amount of from 0.1 to 100% by weight, based on the weight of the substrate.

4. A method according to claim 1, wherein the nucleophilic compound is used in an amount of from 0.001 to 2% by weight, based on the weight of the dye liquor or on the weight of the after-treatment bath.

5. A method according to claim 1, wherein synthetic polyamide fibre material is dyed.

6. A method according to claim 2, wherein treatment of the fibre material with the nucleophilic compound is carried out in a separate after-treatment bath at a temperature of from 50 to 80° C.

7. A method according to claim 3, wherein the compound which reduces the ionic character of the anionic group is used in an amount of from 2 to 40% by weight, based on the weight of the substrate.

* * * * *